US009835034B2

(12) United States Patent
Gronsfelder et al.

(10) Patent No.: US 9,835,034 B2
(45) Date of Patent: Dec. 5, 2017

(54) METHOD FOR DETUNING A ROTOR-BLADE CASCADE

(71) Applicant: Siemens Aktiengesellschaft, Munich (DE)

(72) Inventors: Thomas Gronsfelder, Mulheim an der Ruhr (DE); Jan Walkenhorst, Mulheim an der Ruhr (DE); Armin de Lazzer, Mulheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 191 days.

(21) Appl. No.: 14/764,062

(22) PCT Filed: Jan. 23, 2014

(86) PCT No.: PCT/EP2014/051322
§ 371 (c)(1),
(2) Date: Jul. 28, 2015

(87) PCT Pub. No.: WO2014/122028
PCT Pub. Date: Aug. 14, 2014

(65) Prior Publication Data

US 2016/0010461 A1 Jan. 14, 2016

(30) Foreign Application Priority Data

Feb. 5, 2013 (EP) ..... 13153956

(51) Int. Cl.
*F01D 5/16* (2006.01)

(52) U.S. Cl.
CPC ..... *F01D 5/16* (2013.01); *F05D 2220/30* (2013.01); *F05D 2230/10* (2013.01); *F05D 2260/961* (2013.01)

(58) Field of Classification Search
CPC .. F01D 5/16; F05D 2260/961; F05D 2220/30; F05D 2230/10
See application file for complete search history.

(56) References Cited

U.S. PATENT DOCUMENTS 4,108,573 A 8/1978 Wagner
4,924,706 A 5/1990 Moore
(Continued)

FOREIGN PATENT DOCUMENTS

CN 101762385 A 6/2010
CN 103119248 A 5/2013
(Continued)

OTHER PUBLICATIONS

JP Office Action dated Jul. 15, 2016, for JP application No. 2015-555656.

*Primary Examiner* — Moshe Wilensky
(74) *Attorney, Agent, or Firm* — Beusse Wolter Sanks & Maire

(57) ABSTRACT

A method for detuning a rotor-blade cascade of a turbomachine having a plurality of rotor blades includes: a) establishing at least one target natural frequency for at least one vibration mode; b) setting up a value table having discrete mass values and radial center-of-gravity positions, and determining respective natural frequency; c) measuring the mass and radial center-of-gravity position of one of the rotor blades; d) determining an actual natural frequency by interpolating the measured mass and radial center-of-gravity position in the value table; e) if actual natural frequency is outside a tolerance around target natural frequency, selecting a value pair that at least approximates target natural frequency, and removing material from the rotor blade in such a way that mass and radial center-of-gravity position correspond to the value pair; f) repeating steps c) to e) until actual
(Continued)

natural frequency is within the tolerance around target natural frequency.

19 Claims, 2 Drawing Sheets

(56) References Cited

U.S. PATENT DOCUMENTS

| | | | |
|---|---|---|---|
| 5,988,982 | A | 11/1999 | Clauer |
| 6,042,338 | A | 3/2000 | Brafford |
| 6,814,543 | B2 | 11/2004 | Barb et al. |
| 7,252,481 | B2 | 8/2007 | Stone |
| 7,500,299 | B2 | 3/2009 | Dupeux |
| 7,941,281 | B2 | 5/2011 | Jammu et al. |
| 7,997,873 | B2 | 8/2011 | Slepski et al. |
| 2002/0064458 | A1 | 5/2002 | Montgomery et al. |
| 2005/0249586 | A1 | 11/2005 | Dupeux et al. |
| 2012/0148401 | A1 | 6/2012 | Kulathu et al. |
| 2013/0177427 | A1 | 7/2013 | Kayser |

FOREIGN PATENT DOCUMENTS

| | | | |
|---|---|---|---|
| DE | 102009033618 | A1 | 1/2011 |
| EP | 1589191 | A1 | 10/2005 |
| EP | 1640562 | A1 | 3/2006 |
| JP | S54114619 | A | 9/1979 |
| JP | S5618764 | B2 | 5/1981 |
| JP | S5993901 | A | 5/1984 |
| JP | S59150903 | A | 8/1984 |
| JP | H01106902 | A | 4/1989 |
| JP | 2000265803 | A | 9/2000 |
| JP | 2002257672 | A | 9/2002 |
| JP | 2004211705 | | 7/2004 |
| JP | 2007537385 | | 12/2007 |
| JP | 2010230006 | A | 10/2010 |
| JP | 2012137054 | A | 7/2012 |
| RU | 2382911 | C1 | 2/2010 |

METHOD FOR DETUNING A ROTOR-BLADE CASCADE

CROSS REFERENCE TO RELATED APPLICATIONS

This application is the US National Stage of International Application No. PCT/EP2014/051322 filed Jan. 23, 2014, and claims the benefit thereof. The International Application claims the benefit of European Application No. EP13153956 filed Feb. 5, 2013. All of the applications are incorporated by reference herein in their entirety.

FIELD OF INVENTION

The invention relates to a method for detuning a rotor-blade cascade.

BACKGROUND OF INVENTION

A turbomachine has rotor blades which are arranged in rotor wheels, which may be regarded as firmly clamped at their blade roots and can oscillate during operation of the turbomachine. Depending on the operating state of the turbomachine, oscillation processes may occur in which oscillating states with high and critical stresses in the rotor blade occur. In the event of long-term loading of the blade by critical stress states, material fatigue takes place which can ultimately lead to a lifetime reduction of the blade, necessitating replacement of the rotor blade.

Because of the centrifugal forces acting on the rotor blade during operation of the turbomachine, a prestress is generated in the rotor blade. Owing to this and the high temperature of the rotor blade during operation, the natural frequencies of the rotor blade during operation differ from the natural frequencies of the cold rotor blade at rest. As a quality-assurance measure during manufacture, only the natural frequencies when the turbomachine is at rest can be measured, although for the configuration of the rotor blade it is necessary to know the natural frequencies under the centrifugal force, so that the oscillation processes in which the oscillation states with high and critical stresses in the rotor blade occur can be avoided.

EP 1 589 191 discloses a method for detuning a rotor-blade cascade.

SUMMARY OF INVENTION

It is an object of the invention to provide a method for detuning a rotor-blade cascade of a turbomachine, the rotor blades having a long lifetime during operation of the turbomachine.

The method according to aspects of the invention for detuning, in particular rotor-dynamically detuning, a rotor-blade cascade, comprising a multiplicity of rotor blades, of a turbomachine, has the steps: a) establishing for each of the rotor blades of the rotor-blade cascade at least one setpoint natural frequency $\nu_{F,S}$ which the rotor blade has for at least one predetermined oscillation mode during normal operation of the turbomachine under the effect of centrifugal force, such that the oscillation load of the rotor-blade cascade under the centrifugal force lies below a tolerance limit; b) compiling a value table $\nu_F(m, r_S)$ with selected discrete mass values m and radial center-of-mass positions $r_S$, which result from variations of the nominal geometry of the rotor blade, and determining the respective natural frequency $\nu_F$ of the predetermined oscillation mode under the centrifugal force for each selected value pair m and $r_S$; c) measuring the mass $m_I$ and the radial center-of-mass position $r_{S,I}$ of one of the rotor blades; d) determining an actual natural frequency $\nu_{F,I}$ of the rotor blade under the centrifugal force by interpolation of the measured mass $m_I$ and the measured radial center-of-mass position $r_{S,I}$ in the value table $\nu_F(m, r_S)$; e) in the event that $\nu_{F,I}$ lies outside a tolerance around $\nu_{F,S}$, selecting from the value table $\nu_F(m, r_S)$ a value pair $m_S$ and $r_{S,S}$ such that $\nu_{F,S}$ at least approximates $\nu_{F,S}$, and removing material of the rotor blade in such a way that $m_I$ and $r_{S,I}$ correspond to the value pair $m_S$ and $r_{S,S}$; f) repeating steps c) to e) until $\nu_{F,I}$ lies within the tolerance around $\nu_{F,S}$.

By measuring the mass $m_I$ and the radial center-of-mass position $r_{S,I}$ and by interpolating these values in the value table $\nu_F(m, r_S)$, the natural frequency $\nu_{F,I}$ under the centrifugal force can advantageously be determined with a high accuracy. With the method according to the invention, it is likewise advantageously possible to adjust this natural frequency $\nu_{F,I}$ with a high accuracy and approximate it to the established setpoint natural frequency $\nu_{F,S}$. The oscillation load of the rotor blade during operation of the turbomachine can therefore be reduced, so that the lifetime of the rotor blade is extended. Furthermore, the method can be carried out straightforwardly because, for accurate determination of the actual natural frequency $\nu_{F,I}$, it is surprisingly sufficient to measure $m_I$ and $r_{S,I}$ of the rotor blade without its full geometry. Furthermore, $m_I$ and $r_{S,I}$ are quantities which are simple to measure; for example, $m_I$ can be measured with a balance.

The predetermined oscillation modes are particularly selected in such a way that the natural frequencies $\nu_{F,S}$ associated with the oscillation modes are equal to or of lower frequency than a multiple harmonic of the rotor rotation frequency, in particular the eighth harmonic, a value table $\nu_F(m, r_S)$ respectively being compiled for a multiplicity of or all of the oscillation modes, the actual natural frequency $\nu_{F,I}$ being determined for each value table and the value pair $m_S$ and $r_{S,S}$ being selected in such a way that the determined $\nu_{F,I}$ are at least approximated to the established $\nu_{F,S}$.

The method according to the invention for detuning, in particular rotor-dynamically detuning, a rotor-blade cascade, comprising a multiplicity of rotor blades, of a turbomachine, has the steps: a) establishing for each of the rotor blades of the rotor-blade cascade at least one setpoint natural frequency $\nu_{F,S}$ which the rotor blade has for at least one predetermined oscillation mode during normal operation of the turbomachine under the effect of centrifugal force, such that the oscillation load of the rotor-blade cascade under the centrifugal force lies below a tolerance limit; b) compiling a value table $\nu_F(m, r_S)$ and a value table $\nu_S(m, r_S)$ with selected discrete mass values m and radial center-of-mass positions $r_S$, which result from variations of the nominal geometry of the rotor blade, and determining the respective natural frequency $\nu_F$ of the predetermined oscillation mode under the centrifugal force and the respective natural frequency $\nu_S$ with the rotor blade at rest for each selected value pair m and $r_S$; c) measuring the mass $m_1$ and the radial center-of-mass position $r_{S,I}$ of one of the rotor blades; d) determining an actual natural frequency $\nu_{F,I}$ of the rotor blade under the centrifugal force by interpolation of the measured mass $m_I$ and the measured radial center-of-mass position $r_{S,I}$ in the value table $\nu_F(m, r_S)$; e) in the event that $\nu_{F,I}$ lies outside a tolerance around $\nu_{F,S}$, selecting from the value table $\nu_F(m, r_S)$ a value pair $m_S$, $r_{S,S}$ such that $\nu_{F,I}$ at least approximates $\nu_{F,S}$, and removing material of the rotor blade in such a way that $m_I$ and $r_{S,I}$ correspond to the value pair $m_S$, $r_{S,S}$; f) in the event that material has been removed, measuring an natural frequency $\nu_{S,I}$ of the rotor blade at rest; g) repeating steps e) to f or c) to f) until $\nu_{F,I}$ lies within the tolerance around $\nu_{F,S}$ and $\nu_{S,I}$ lies within a tolerance around $\nu_{S,S}$ corresponding to the tolerance.

By the additional measurement of the natural frequency $\nu_{S,I}$, the actual natural frequency $\nu_{F,I}$ under the centrifugal force can advantageously be determined with an even higher accuracy. It is also possible to use the measurement of the natural frequency $\nu_{S,I}$ at rest in order to monitor the removal, without repeating the measurement of $m_1$ and $r_{S,I}$.

The predetermined oscillation modes are particularly selected in such a way that the natural frequencies $\nu_{F,S}$ associated with the oscillation modes are equal to or of lower frequency than a multiple harmonic of the rotor rotation frequency, in particular the eighth harmonic, respectively a value table $\nu_F(m, r_S)$ and respectively a value table $\nu_S(m, r_S)$ being compiled for a multiplicity of or all of the oscillation modes, the actual natural frequency $\nu_{F,I}$ and the actual natural frequency $\nu_{S,I}$ being determined for each value table and the value pair $m_S$ and $r_{S,S}$ being selected in such a way that the determined $\nu_{F,I}$ are at least approximated to the established $\nu_{F,S}$ and the natural frequencies $\nu_{S,I}$ being measured for the predetermined oscillation modes.

The variations of the nominal geometry may comprise thickening and/or thinning of the rotor blade in each radial section or in radial sections. It is advantageous for the variations of the nominal geometry to comprise a linear variation of the thickness of the rotor blade over the radius. It is advantageously possible to combine the value table using the thickening and thinning of the nominal geometry with an accuracy sufficient for determining the natural frequencies $\nu_F$ and $\nu_S$.

The setpoint natural frequencies $\nu_{F,S}$ are particularly established in such a way that rotor blades arranged next to one another in the rotor-blade cascade have unequal setpoint natural frequencies $\nu_{F,S}$, and that the setpoint natural frequencies $\nu_{F,S}$ are different to the rotor rotation frequency during normal operation of the turbomachine up to and including a multiple harmonic of the rotor rotation frequency, in particular the eighth harmonic of the rotor rotation frequency. This prevents an oscillating rotor blade being able to excite a rotor blade next to it in an oscillation, and coupling of the rotation of the rotor-blade cascade with the oscillations of the rotor blades taking place. The oscillation loads of the rotor blades are therefore low and their lifetime is long.

It is advantageous for the measurement of the mass $m_I$ and of the center-of-mass position $r_{S,I}$ to be carried out relatively in a different difference measurement with respect to a reference blade which has been three-dimensionally measured, in particular by a coordinate measuring device and/or by an optical method. The accuracy of a measurement depends on the size of the measurement range, a larger measurement range resulting in a lower accuracy. By carrying out the measurement of $m_I$ and $r_{S,I}$ relative to a reference blade, a small measurement range with a high accuracy can be used. It is therefore necessary only to take a single rotor blade as thereference blade and to characterize it once by a cost-intensive three-dimensional method, so that $m_I$ and $r_{S,I}$ of all the other rotor blades can also be measured with the high accuracy.

It is advantageous for the value pairs $m_S$ and $r_{S,S}$ to be selected in such a way that the unbalance of the rotor is reduced and/or that the outlay for the removal is minimal. Knowledge of the value pair $m_S$ and $r_{S,S}$ is sufficient for an unbalance of the rotor, so that detuning and balancing of the rotor-blade cascade can be carried out in a common method step by the removal of the material. The removal of the material may also be carried out in such a way that the amount of material to be removed is minimized.

The predetermined oscillation mode is particularly selected in such a way that the natural frequency $\nu_{F,S}$ of the predetermined oscillation mode is equal to or of lower frequency than a multiple harmonic of the rotor rotation frequency, in particular the eighth harmonic. The natural frequencies $\nu_F$ and/or $\nu_I$ are particluarly determined computationally, in particular by a finite element method.

It is advantageous that, during the measurement of the frequency $\nu_{S,I}$, the rotor blade is clamped at its blade root, and the oscillation of the rotor blade is excited and measured. The oscillation is particularly measured by oscillation transducers, acceleration sensors, strain gages, piezoelectric sensors and/or optical methods. This constitutes a simple method for determining the natural frequency.

Adaptation of the model for determining the natural frequencies $\nu_F$ and $\nu_S$ is particularly carried out by a comparison of the measured natural frequency $\nu_{S,I}$ with an actual natural frequency determined by interpolation of $m_I$ and $r_{S,I}$ in the value table $\nu_S(m, r_S)$. In this way, influences of the material on the natural frequencies can advantageously be taken into account as well.

BRIEF DESCRIPTION OF THE DRAWINGS

The invention will be explained in more detail below with the aid of the appended schematic drawings, in which.

DETAILED DESCRIPTION OF INVENTION

Figure 1:
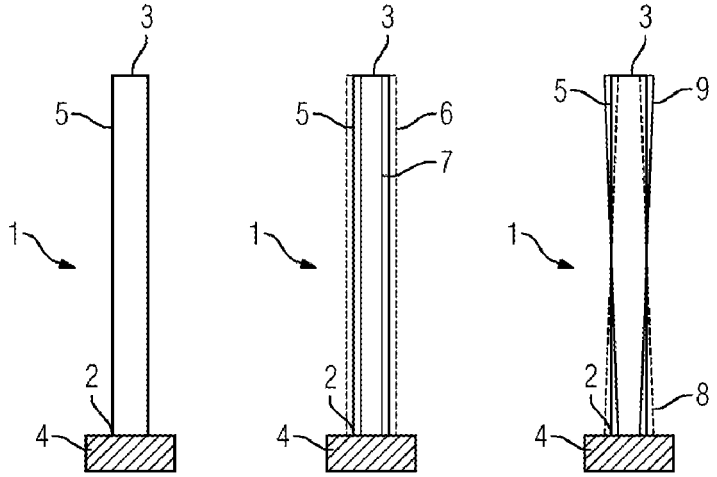
FIG. 1 shows longitudinal sections of three rotor blades with a nominal geometry of the rotor blade and variations of the nominal geometry.

FIG. 1 shows three rotor blades 1 of a turbomachine, the first rotor blade being represented in its nominal geometry 5, the second rotor blade both in its nominal geometry 5 and in a first variation 6 and a second variation 7, and the third rotor blade both in its nominal geometry 5 and in a third variation 8 and a fourth variation 9. The rotor blades 1 have a blade root 2, which is firmly fitted on a rotor 4 of the turbomachine, and a blade tip 3 facing away from the blade root 2. In the event of an oscillation of the rotor blade 1 during operation of the turbomachine, an oscillation node is arranged at the blade root 2. The radius r of the rotor blade 1 is directed from the blade root 2 to the blade tip 3.

The second rotor blade shows variations 6, 7 of the nominal geometry 5, in which, starting from the nominal geometry 5 the mass m is varied but the radial center-of-mass position $r_S$ of the rotor blade is not. In the first variation 6, the mass m is increased by uniformly thickening the second rotor blade at each radial distance r from the rotation axis, and in the second variation 7 the mass m is reduced by radially thinning the second rotor blade at each radial distance r.

In the variations 8, 9 of the third rotor blade, starting from the nominal geometry 5 the thickness of the rotor blade is varied linearly over the radius r in the circumferential direction and/or the axial direction. According to the third variation 8, starting from the nominal geometry 5 the rotor blade is thickened at its blade root 2 and thinned at its blade tip 3, and according to the fourth variation 9, starting from the nominal geometry 5 the rotor blade is thinned at its blade root 2 and thickened at its blade tip 3. Because of this, in the third variation 8, the radial center-of-mass position $r_S$ is displaced radially inward and in the fourth variation 9 it is displaced radially outward, although the mass m does not change. The variations 8, 9 may, however, be carried out in such a way that both the mass m and the radial center-of-mass position $r_S$ are varied. Furthermore, it is possible to carry out the mass m and the radial center-of-mass position $r_S$ by thickening and/or thinning the rotor blade 1 in selected radial sections.

A multiplicity of variations of the nominal geometry 5 are carried out, and for each variation the natural frequency $\nu_S$ of the lowest-frequency bending oscillation of the rotor blade 1 clamped at its blade root 2 and at rest is calculated by a finite element method. Furthermore, for each variation the natural frequency $\nu_F$ of the same bending oscillation is calculated, the centrifugal force acting on the rotor blade 1 during operation of the turbomachine being taken into account. Optionally, an elevated temperature and material properties therefore varying may be taken into account in the calculation of $\nu_F$. For a given rotor-blade cascade, it is advantageously possible only to carry out the variations of the nominal geometry once.

Figure 2:
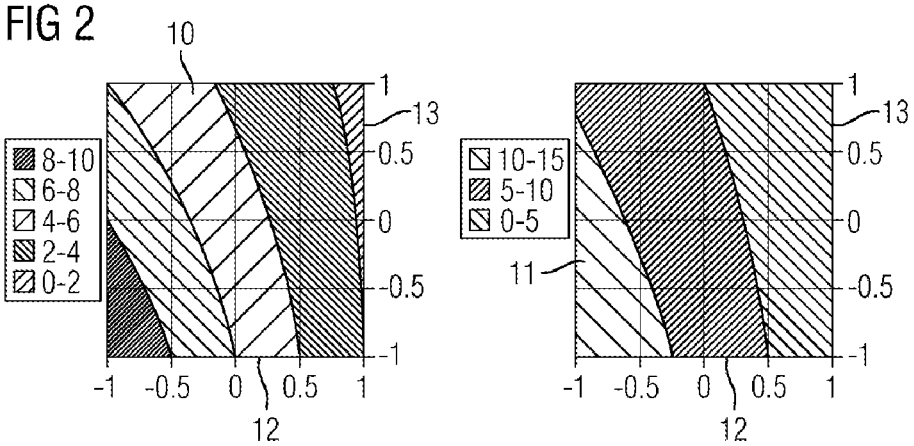
FIG. 2 shows a two-dimensional graph of natural frequencies $\nu_S$ of the rotor blade at rest and a two-dimensional graph of the natural frequencies $\nu_F$ of the rotor blade under centrifugal force, as a function of the mass m and the radial center-of-mass position $r_S$ of the rotor blade.

Subsequently, for each variation of the nominal geometry 5, the mass m and the radial center-of-mass position $r_S$ of the rotor blade 1 are determined and a value table $\nu_S(m, r_S)$ with value triplets $\nu_S$, m, $r_S$ and a value table $\nu_F(m, r_S)$ with value triplets $\nu_F$, m, $r_S$ are compiled. The value table $\nu_S(m, r_S)$ is represented in the left-hand graph of FIG. 2 and the value table $\nu_F(m, r_S)$ is represented in the right-hand graph of FIG. 2, by plotting the respective natural frequency $\nu_S$ 10 and $\nu_F$ 11 against the mass m 12 and the radial center-of-mass position $r_S$ 13. The natural frequencies $\nu_S$ 10 and $\nu_F$ 11 are plotted in arbitrary units and the nominal geometry 5 is respectively plotted for m=0 and $r_S$=0. It can be seen from FIG. 2 that a reduction of the mass m and a displacement of the center-of-mass position $r_S$ inward are associated with an increase of the natural frequencies $\nu_S$ 10 and $\nu_F$ 11.

Figure 3:
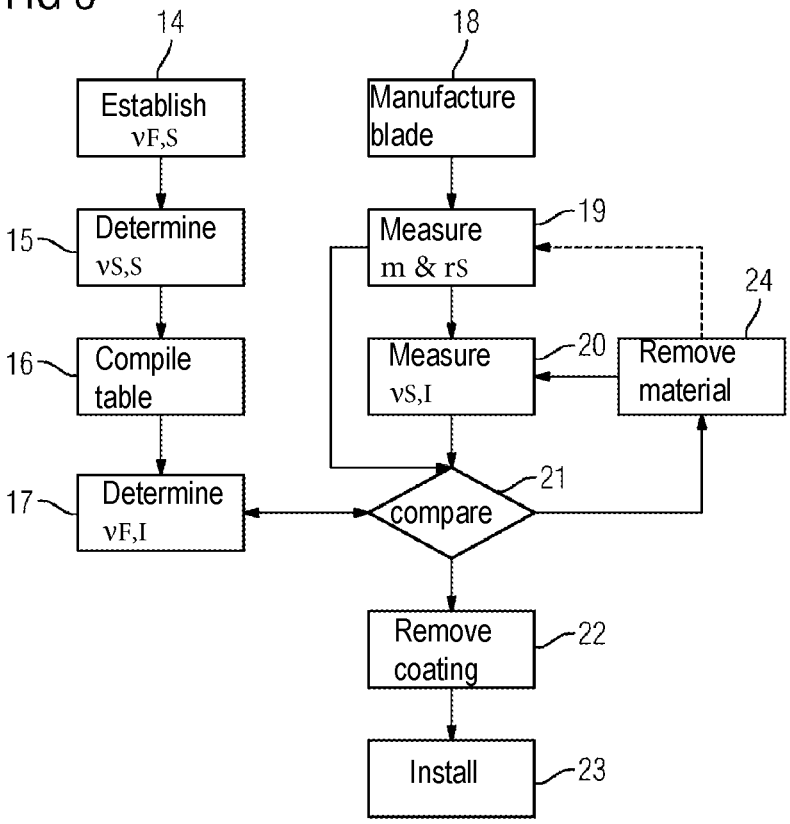
FIG. 3 shows a flowchart of the method according to the invention.

FIG. 3 represents the method according to the invention in a flowchart. For each of the rotor blades 1 of the rotor-blade cascade, a setpoint natural frequency $\nu_{F,S}$, which the rotor blade 1 has for the lowest-frequency bending oscillation of the rotor blade 1 firmly clamped at its blade root 2 during normal operation of the turbomachine under a centrifugal force, is established 14 such that the oscillation load of the rotor-blade cascade under the centrifugal force lies below a tolerance limit. This is achieved in that rotor blades arranged next to one another in the rotor-blade cascade have unequal setpoint natural frequencies $\nu_{F,S}$, and that the setpoint natural frequencies $\nu_{F,S}$ are different to the rotor rotation frequency of the turbomachine up to and including the eighth harmonic of the rotor rotation frequency.

Subsequently, for each setpoint natural frequency $\nu_{F,S}$, a corresponding setpoint natural frequency $\nu_{S,S}$, which the rotor blade 1 has for the lowest-frequency bending oscillation of the rotor blade 1 firmly clamped at its blade root 2 at rest, is determined 15. Following this, as described above, the value table $\nu_S(m, r_S)$ and the value table $\nu_F(m, r_S)$ are compiled 16 using the variations of the nominal geometry 5.

After manufacture 18 of the rotor blade 1, its mass m and radial center-of-mass position $r_S$ are measured 19. Subsequently, the actual natural frequency $\nu_{F,I}$ of the rotor blade 1 under the centrifugal force is determined 17 by interpolation of the measured mass $m_I$ and the measured radial center-of-mass position $r_{S,I}$ in the value table $\nu_F(m, r_S)$.

An actual/setpoint match 21 is carried out by comparing $\nu_{F,I}$ with $\nu_{F,S}$. In the event that $\nu_{F,I}$ lies outside a tolerance around $\nu_{F,S}$, a value pair $m_S$ and $r_{S,S}$ is selected from the value table $\nu_F(m, r_S)$ such that $\nu_{F,I}$ at least approximates $\nu_{F,S}$, and material is removed 24 from the rotor blade 1 in such a way that $m_I$ and $r_{S,I}$ correspond to the value pair $m_S$ and $r_{S,S}$. As can be seen from the right-hand graph of FIG. 2, a multiplicity of value pairs $m_S$ and $r_{S,S}$ are generally available for achieving a certain natural frequency $\nu_{F,S}$. From the multiplicity of value pairs, it is possible to select a value pair $m_S$ and $r_{S,S}$ such that the rotor of the turbomachine is unbalanced and/or the outlay for the removal is minimal. The removal 24 may, for example be carried out by grinding.

In order to monitor the removal 24, the natural frequency $\nu_{S,I}$ of the rotor blade 1 at rest may be measured 20. To this end, the rotor blade 1 is clamped at its blade root 2, the oscillation of the rotor blade 1 is excited, for example by impact, and the sound emitted by the rotor blade 1 is measured. As an alternative, in order to monitor the removal 24, the mass m and the radial center-of-mass position $r_S$ of the rotor blade 1 may be measured 19. The monitoring can be carried out with a particularly high accuracy by measuring both the natural frequency $\nu_{S,I}$ 20 and the mass m and the radial center-of-mass position $r_S$ 19.

It is also possible to measure both the mass m and the radial center-of-mass position $r_S$ 19 and the natural frequency $\nu_{S,I}$ 20 already before the removal 24 of the material, so as to measure the actual natural frequency $\nu_{F,I}$ with a particularly high accuracy. By a comparison of the measured natural frequency $\nu_{S,I}$ with an actual natural frequency determined by interpolation of $m_I$ and $r_{S,I}$ in the value table $\nu_S(m, r_S)$, adaptation of the model for determining the natural frequencies $\nu_F$ and $\nu_S$ can be carried out.

In the event that $\nu_{F,I}$ lies inside a tolerance around $\nu_{F,S}$, method steps 22 may optionally be carried out on the rotor blade 1, for example removal of a coating. The rotor blade 1 is subsequently installed in the rotor-blade cascade 23.

Although the invention has been illustrated and described in detail with reference to the preferred exemplary embodiments, the invention is not restricted by the examples disclosed and other variants may be derived therefrom by the person skilled in the art without departing from the protective scope of the invention.

The invention claimed is:

1. A method for detuning a rotor-blade cascade, comprising a multiplicity of rotor blades, of a turbomachine, the method comprising:

a) establishing for each of the rotor blades of the rotor-blade cascade at least one setpoint natural frequency $\nu_{F,S}$ which the rotor blade has for at least one predetermined oscillation mode during normal operation of the turbomachine under the effect of centrifugal force, such that the oscillation load of the rotor-blade cascade under the centrifugal force lies below a tolerance limit;

b) compiling a value table $\nu_F(m, r_S)$ with selected value pairs of discrete mass values m and radial center-of-mass positions $r_S$, which result from variations of the nominal geometry of the rotor blade, and determining the respective natural frequency $\nu_F$ of the predetermined oscillation mode under the centrifugal force for each selected value pair m and $r_S$;

c) measuring the mass $m_I$ and the radial center-of-mass position $r_{S,I}$ of one of the rotor blades;

d) determining actual natural frequency $\nu_{F,I}$ of the rotor blade under the centrifugal force by interpolation of the measured mass $m_I$ and the measured radial center-of-mass position $r_{S,I}$ in the value table $\nu_F(m, r_S)$;

e) in the event that the actual natural frequency $\nu_{F,I}$ lies outside a tolerance around the setpoint natural frequency $\nu_{F,S}$, selecting from the value table $\nu_F(m, r_S)$ a value pair $m_S$ and $r_{S,S}$ such that the actual natural frequency $\nu_{F,I}$ at least approximates the setpoint natural frequency $\nu_{F,S}$, and removing material of the rotor blade such that $m_I$ and $r_{S,I}$ correspond to the value pair $m_S$ and $r_{S,S}$;

f) repeating steps c) to e) until the actual natural frequency $\nu_{F,I}$ lies within the tolerance around the setpoint natural frequency $\nu_{F,S}$.

2. The method as claimed in claim 1, wherein in addition to step b), further comprising:

b1) compiling a value table $\nu_S(m, r_S)$ with selected value pairs of discrete mass values m and radial center-of-mass positions $r_S$, which result from variations of the nominal geometry of the rotor blade, and determining the respective natural frequency $\nu_S$ of the predetermined oscillation mode with the rotor blade at rest for each selected value pair m and $r_S$;

f) in the event that material has been removed, measuring a natural frequency $\nu_{S,I}$ of the rotor blade at rest;

g) repeating steps e) to f or c) to f) until the actual natural frequency $\nu_{F,I}$ lies within the tolerance around the setpoint natural frequency $\nu_{F,S}$ and the natural frequency $\nu_{S,I}$ at rest lies within a tolerance around a setpoint natural frequency $\nu_{S,S}$ at rest corresponding to the tolerance.

3. The method as claimed in claim 1, wherein the predetermined oscillation modes are selected such that the setpoint natural frequencies $\nu_{F,S}$ associated with the oscillation modes are equal to or of lower frequency than a multiple harmonic of the rotor rotation frequency, wherein the value table $\nu_F(m, r_S)$ is respectively compiled for a multiplicity of or all the oscillation modes, the actual natural frequency $\nu_{F,I}$ is determined for each value table and the value pair $m_S$ and $r_{S,S}$ is selected such that the determined actual natural frequencies $\nu_{F,I}$ are at least approximated to the established setpoint natural frequencies $\nu_{F,S}$.

4. The method as claimed in claim 2, wherein the predetermined oscillation modes are selected in such a way that the setpoint natural frequencies $\nu_{F,S}$ associated with the oscillation modes are equal to or of lower frequency than a multiple harmonic of the rotor rotation frequency, wherein respectively the value table $\nu_F(m, r_S)$ and respectively the value table $\nu_S(m, r_S)$ are compiled for a multiplicity of or all the oscillation modes, the actual natural frequency $\nu_{F,I}$ under the effect of centrifugal force and the actual natural frequency $\nu_{S,I}$ at rest are determined for each value table and the value pair $m_S$ and $r_{S,S}$ are selected in such a way that the determined actual natural frequencies $\nu_{F,I}$ are at least approximated to the established setpoint natural frequencies $\nu_{F,S}$ and the actual natural frequencies $\nu_{S,I}$ at rest are measured for the predetermined oscillation modes.

5. The method as claimed in claim 1, wherein the variations of the nominal geometry comprise thickening and/or thinning of the rotor blade in each radial section or in radial sections.

6. The method as claimed in claim 1, wherein the variations of the nominal geometry comprise a linear variation of the thickness of the rotor blade over the radius.

7. The method as claimed in claim 1, wherein the setpoint natural frequencies $\nu_{F,S}$ are established in such a way that rotor blades arranged next to one another in the rotor-blade cascade have unequal setpoint natural frequencies $\nu_{F,S}$, and that the setpoint natural frequency $\nu_{F,S}$ are different to the rotor rotation frequency of the turbomachine up to and including a multiple harmonic of the rotor rotation frequency.

8. The method as claimed in claim 1, wherein the measurement of the mass $m_I$ and of the center-of-mass position $r_{S,I}$ is carried out relatively in a difference measurement with respect to a reference blade which has been three-dimensionally measured.

9. The method as claimed in claim 1, wherein the value pairs $m_S$ and $r_{S,S}$ are selected such that the unbalance of the rotor is reduced and/or that the outlay for the removal is minimal.

10. The method as claimed in claim 1, wherein the predetermined oscillation mode is selected such that the setpoint natural frequency $\nu_{F,S}$ of the predetermined oscillation mode is equal to or of lower frequency than a multiple harmonic of the rotor rotation frequency.

11. The method as claimed in claim 1, wherein the natural frequencies $\nu_F$ and/or $\nu_I$ are determined computationally.

12. The method as claimed in claim 2, wherein, during the measurement of the actual natural frequency $\nu_{S,I}$ at rest, the rotor blade is clamped at its blade root, and the oscillation of the rotor blade is excited and measured.

13. The method as claimed in claim 2, wherein adaptation of the model for determining the natural frequencies $\nu_F$ and $\nu_I$ is carried out by a comparison of the measured actual natural frequency $\nu_{S,I}$ with an actual natural frequency determined by interpolation of $m_1$ and $r_{S,I}$ in the value table $\nu_S(m, r_S)$.

14. The method as claimed in 3, wherein the multiple harmonic of the rotor rotation frequency is the eighth harmonic.

15. The method as claimed in 4, wherein the multiple harmonic of the rotor rotation frequency is the eighth harmonic.

16. The method as claimed in 7, wherein the multiple harmonic of the rotor rotation frequency is the eighth harmonic.

17. The method as claimed in 10, wherein the multiple harmonic of the rotor rotation frequency is the eighth harmonic.

18. The method as claimed in 8, wherein the measurement of the mass $m_I$ and of the center-of-mass position $r_{S,I}$ is carried out by a coordinate measuring device and/or by an optical method.

19. The method as claimed in 11, wherein the natural frequencies $\nu_F$ and/or $\nu_I$ are determined computationally by a finite element method.

* * * * *